US012292253B2

(12) United States Patent
Cudal et al.

(10) Patent No.: US 12,292,253 B2
(45) Date of Patent: May 6, 2025

(54) ADAPTER FOR AIRSOFT GUN

(71) Applicants: Renfield Cudal, West Palm Beach, FL (US); Arren Cudal, West Palm Beach, FL (US)

(72) Inventors: Renfield Cudal, West Palm Beach, FL (US); Arren Cudal, West Palm Beach, FL (US)

( * ) Notice: Subject to any disclaimer, the term of this patent is extended or adjusted under 35 U.S.C. 154(b) by 132 days.

(21) Appl. No.: 18/455,304

(22) Filed: Aug. 24, 2023

(65) Prior Publication Data

US 2025/0067537 A1 Feb. 27, 2025

Related U.S. Application Data

(63) Continuation-in-part of application No. 18/327,010, filed on May 31, 2023, now Pat. No. 11,913,750.

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/723; F41B 11/62
USPC ..... 124/75
See application file for complete search history.

(56) References Cited

U.S. PATENT DOCUMENTS 2,110,509 A * 3/1938 Von Latscher-Latka ..... F41B 11/55 124/58
2,881,752 A * 4/1959 Blahnik ..... F41B 11/51 124/75
9,885,537 B2 * 2/2018 Tippmann, Jr. ..... F41B 11/723
2010/0224180 A1 * 9/2010 Tippmann, Jr. ..... F41B 11/62 124/74
2012/0192846 A1 * 8/2012 Rice ..... F41B 11/57 124/73
2014/0165984 A1 * 6/2014 Colby ..... F41B 11/723 124/73
2015/0007804 A1 * 1/2015 Tippmann, Jr. ..... F41B 11/70 124/73
2017/0211906 A1 * 7/2017 Colby ..... F41B 11/723

* cited by examiner

*Primary Examiner* — Samir Abdosh
(74) *Attorney, Agent, or Firm* — Mark Terry

(57) ABSTRACT

An adapter for airsoft guns includes a housing comprising a single, integrally formed plastic element, the housing having an upper portion configured to mate with a magazine well of the airsoft gun, an air reservoir located within the housing for holding pressurized gas, an air inlet configured for allowing ingress of pressurized air from an attached gas canister, an air outlet configured for allowing egress of pressurized air from the air reservoir, a piston valve between the air reservoir and the air outlet configured for preventing airflow from the air reservoir to the air outlet when in the rest position, and allowing temporary airflow from the air reservoir to the air outlet when contacted by a firing pin of the airsoft gun, a projectile inlet configured for allowing ingress of projectiles from an attached projectile magazine, and a projectile outlet configured for allowing egress of projectiles to the airsoft gun.

20 Claims, 21 Drawing Sheets

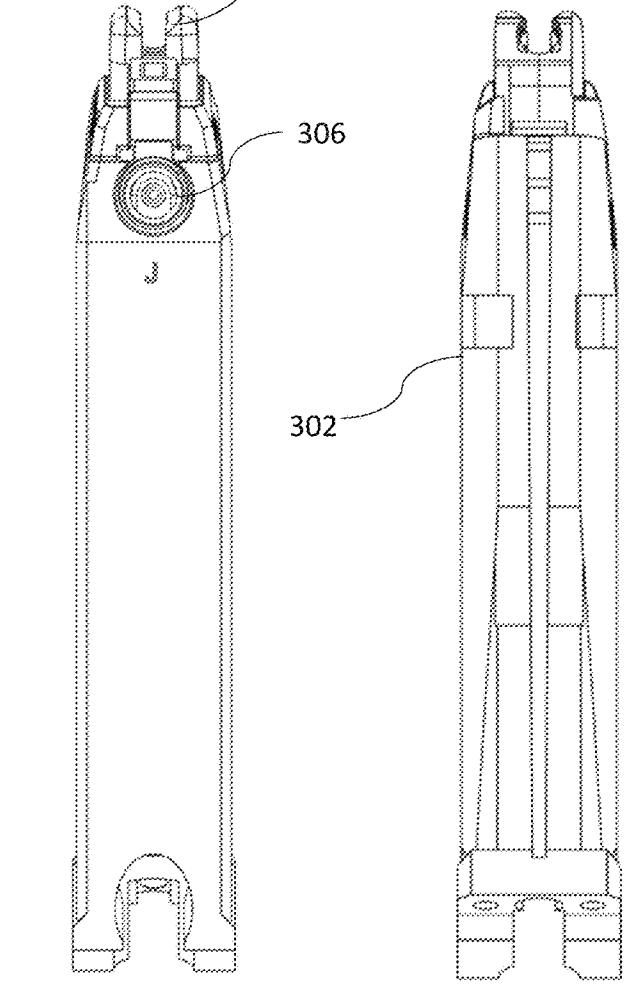
FIG. 3G
FIG. 3F
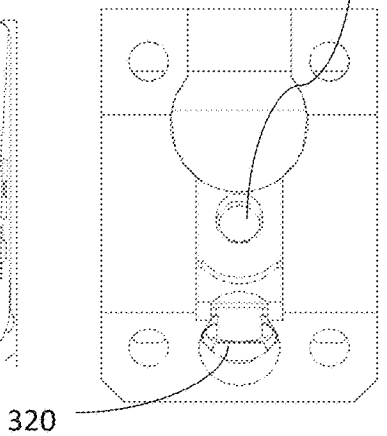
FIG. 3E
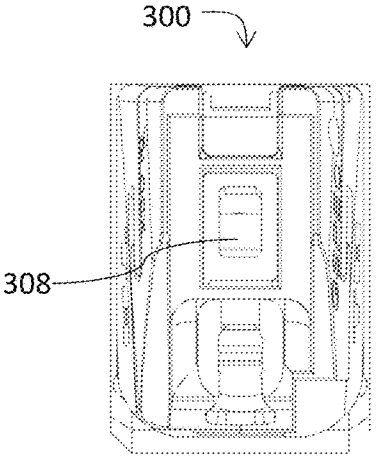
FIG. 3D

ADAPTER FOR AIRSOFT GUN

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the gun industry and, more specifically, relates to the field of products and accessories for guns used in the sport of airsoft.

BACKGROUND

Airsoft guns operate on a wholly different principle than gunpowder powered firearms. Gas-powered airsoft guns, a favored choice among many enthusiasts, work on a simple, yet effective principle: they use compressed gas to propel the plastic projectiles, otherwise known as BBs. This gas, often referred to as 'green gas' (a propane-based mixture) or $CO^2$, is stored in a canister or cartridge that is usually housed within the magazine or the grip of the gun. When the trigger is pulled, a valve on the gas canister or cartridge opens, releasing a measured burst of gas. This gas expands rapidly and drives the BB down the barrel of the gun and out towards the target. Due to their design, gas-powered guns are capable of semi-automatic and fully automatic fire.

Key components in a gas-powered airsoft gun include the gas canister or cartridge, the magazine, the BBs, and the firing mechanism. The gas canister is a reservoir that holds the pressurized gas, which can be refilled or replaced depending on the design of the gun. The magazine, besides housing the gas canister in some designs, also holds the BBs, and feeds them into the firing chamber. The firing mechanism, also known as the bolt in some designs, strikes the release valve on the gas canister when the trigger is pulled, allowing gas to propel the BB. The BBs themselves are usually small in diameter and made of plastic, with different weights available to cater to different needs and preferences in terms of range and accuracy.

There are several problems that have arisen regarding compatibility of airsoft gun components. One of the primary compatibility issues in gas-powered airsoft guns is related to the gas canisters. Gas-powered guns can be designed to use either 'green gas' or $CO^2$ canisters, and while some guns are adaptable and can use both types, many are not. This means that a green gas canister will not fit or function in a $CO^2$ gun and vice versa. Further, even within the same type of gas, canisters from different manufacturers can differ in size, shape, and valve type, making them incompatible with certain guns. This lack of standardization can be frustrating for airsoft enthusiasts, as it restricts their options and can lead to additional costs if a specific brand or type of canister is more expensive or harder to obtain.

The BBs and magazines pose further compatibility issues. In terms of BBs, most airsoft guns are designed to fire standard size BBs, but the weight of the BBs can significantly affect performance, and not all guns are capable of effectively firing the heavier or lighter variants. This means that players often need to experiment with BBs from different manufacturers to find the ones that work best with their specific gun. As for magazines, there's a notable lack of cross-compatibility between different brands and models. An airsoft gun will usually only accept a magazine designed specifically for that model, or occasionally, a series of models from the same manufacturer. This can be problematic if magazines for a particular model are discontinued or hard to find, and it also prevents players from being able to share magazines during games, even if they are using similar types of gas-powered guns. This absence of universal compatibility presents ongoing challenges for airsoft enthusiasts.

Therefore, a need exists to overcome the problems with the prior art as discussed above, and particularly for a more efficient and user-friendly way of making airsoft components compatible with each other.

SUMMARY

An adapter for airsoft guns is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an adapter for airsoft guns is provided that solves the above-described problems. The adapter for airsoft guns includes a housing comprising a single, integrally formed plastic element, the housing having an upper portion configured to mate with a magazine well of the airsoft gun, an air reservoir located within the housing, the air reservoir for holding pressurized gas, an air inlet located at a bottom of the housing, the air inlet coupled with the air reservoir and configured for allowing ingress of pressurized air from an attached gas canister. an air outlet located at a top of the housing, the air outlet coupled with the air reservoir and configured for allowing egress of pressurized air from the air reservoir to the airsoft gun, a piston valve located within the housing between the air reservoir and the air outlet, the piston valve configured for preventing airflow from the air reservoir to the air outlet when in the rest position, and allowing temporary airflow from the air reservoir to the air outlet when contacted by a firing pin of the airsoft gun, a projectile inlet located at the bottom of the housing, the projectile inlet configured for allowing ingress of projectiles from an attached projectile magazine, and a projectile outlet located at the top of the housing, the projectile outlet coupled with the projectile inlet and configured for allowing egress of projectiles to the airsoft gun.

BRIEF DESCRIPTION OF THE DRAWINGS

The accompanying drawings, which are incorporated in and constitute a part of this disclosure, illustrate various example embodiments. In the drawings:

FIG. 3D depicts a top view of the adapter for airsoft guns, according to the third embodiment.

FIG. 3E depicts a bottom view of the adapter for airsoft guns, according to the third embodiment.

FIG. 3F depicts a rear view of the adapter for airsoft guns, according to the third embodiment.

FIG. 3G depicts a front view of the adapter for airsoft guns, according to the third embodiment.

according to the second embodiment.

Figure 1A:
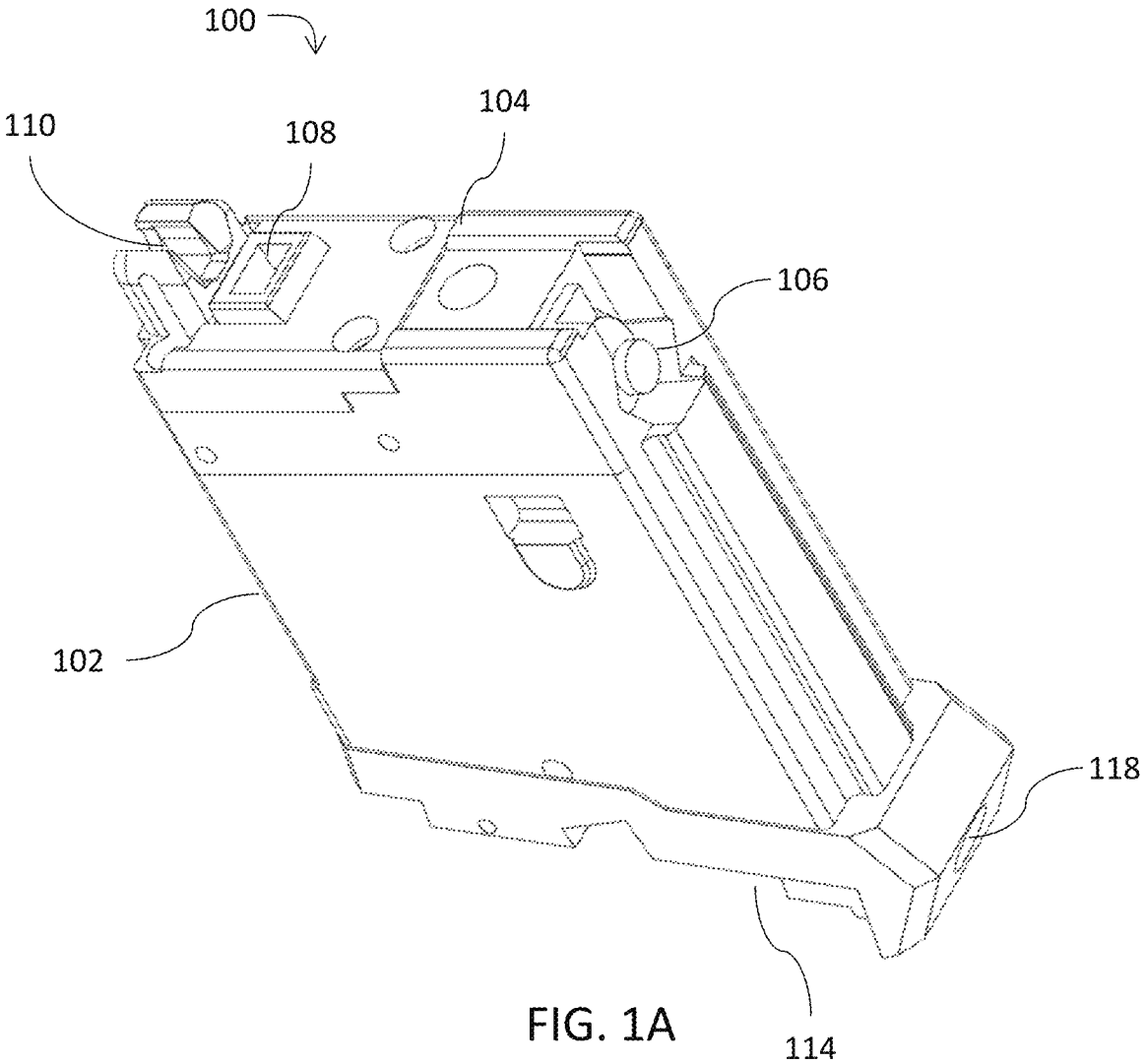
FIG. 1A depicts a top perspective view of an adapter for airsoft guns, according to a first embodiment.
Figure 1C:
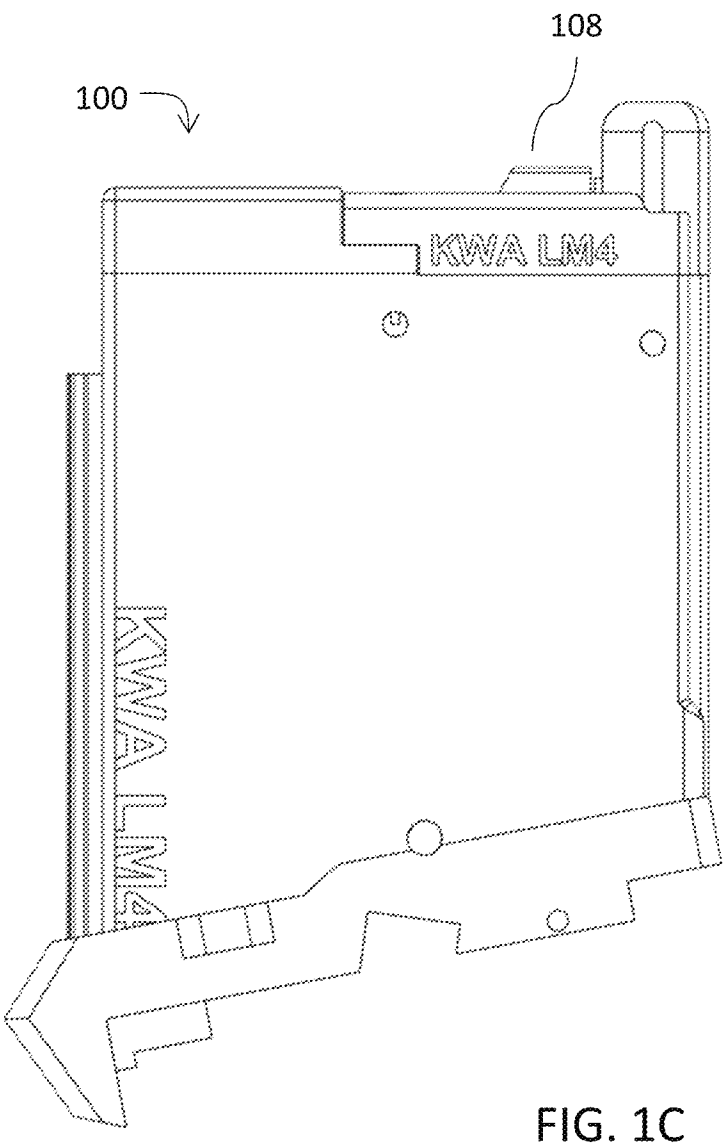
FIG. 1C depicts a left-side view of the adapter for airsoft guns, according to the first embodiment.
Figure 1B:
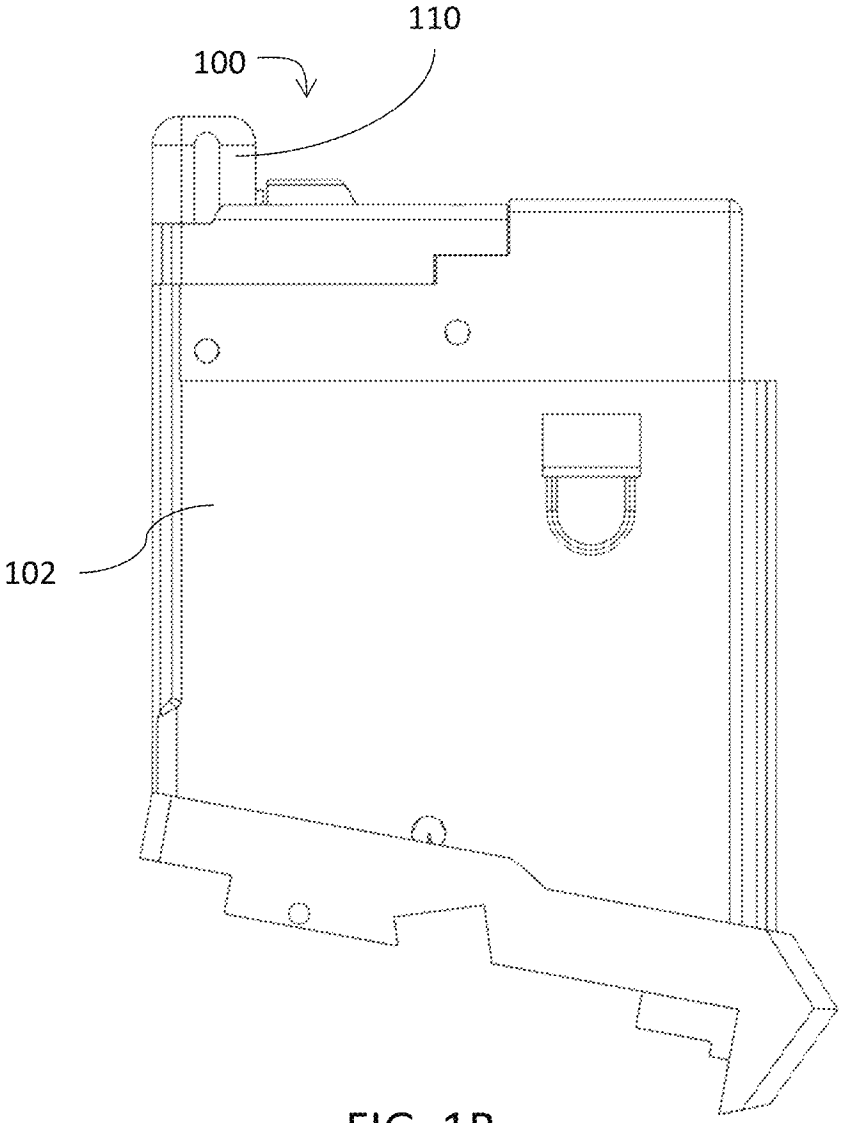
FIG. 1B depicts a right-side view of the adapter for airsoft guns, according to the first embodiment.
Figure 1G:
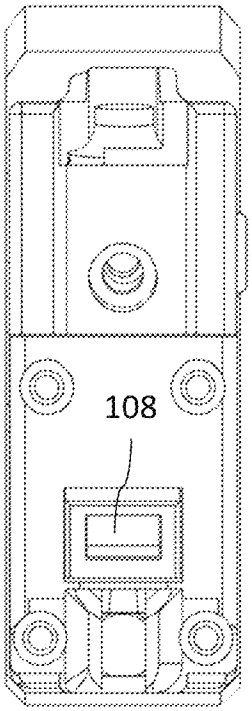
FIG. 1G depicts a top view of the adapter for airsoft guns, according to the first embodiment.
Figure 1F:
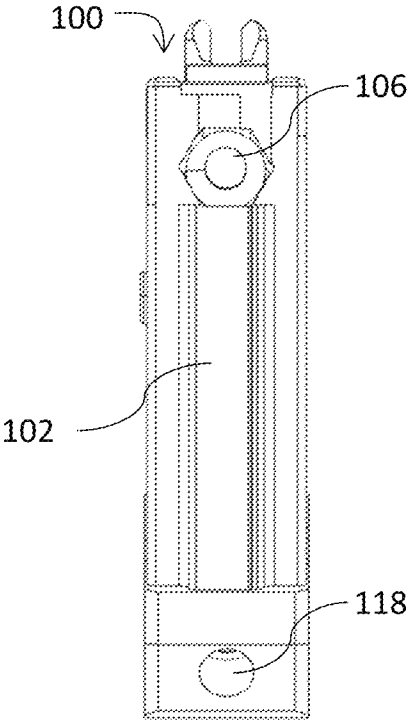
FIG. 1F depicts a rear view of the adapter for airsoft guns, according to the first embodiment.
Figure 1E:
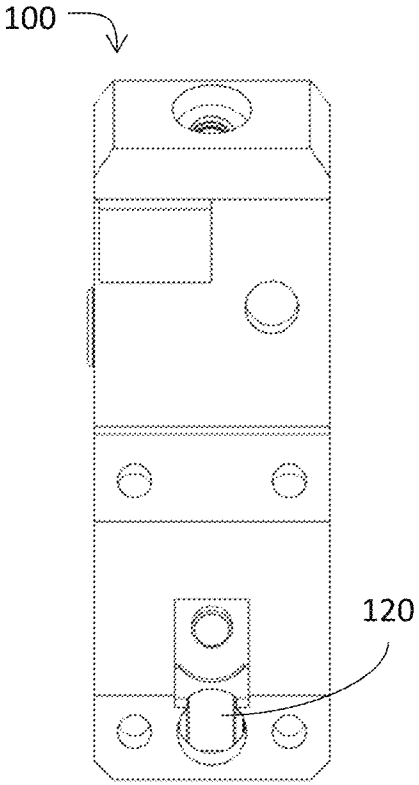
FIG. 1E depicts a bottom view of the adapter for airsoft guns, according to the first embodiment.
Figure 1D:
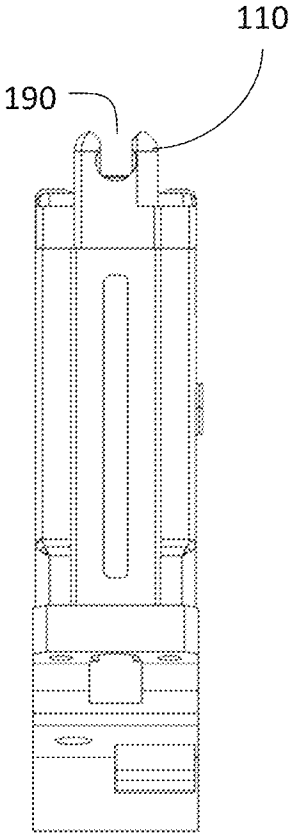
FIG. 1D depicts a front view of the adapter for airsoft guns, according to the first embodiment.
Figure 1H:
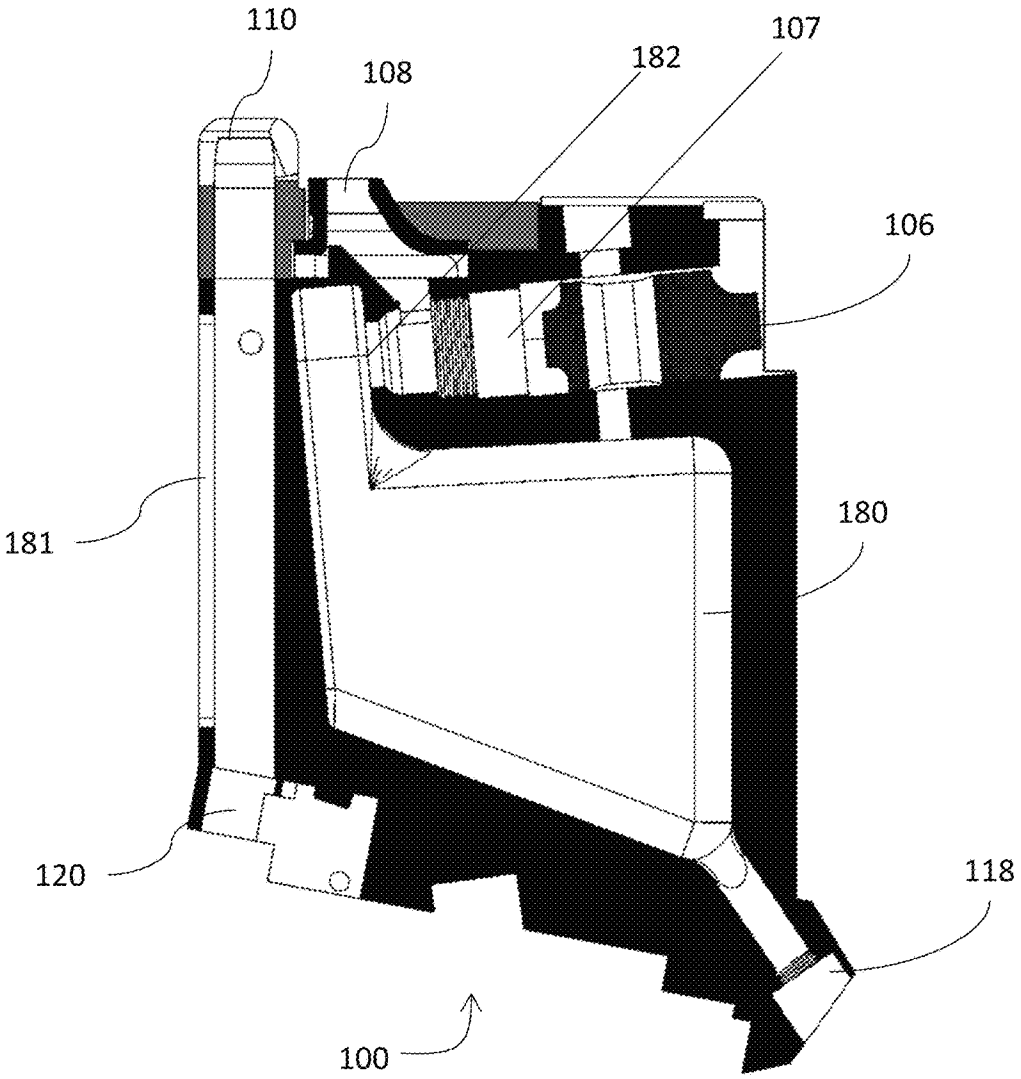
FIG. 1H depicts a cross-sectional side view of the adapter for airsoft guns, according to the first embodiment.
Figure 2A:
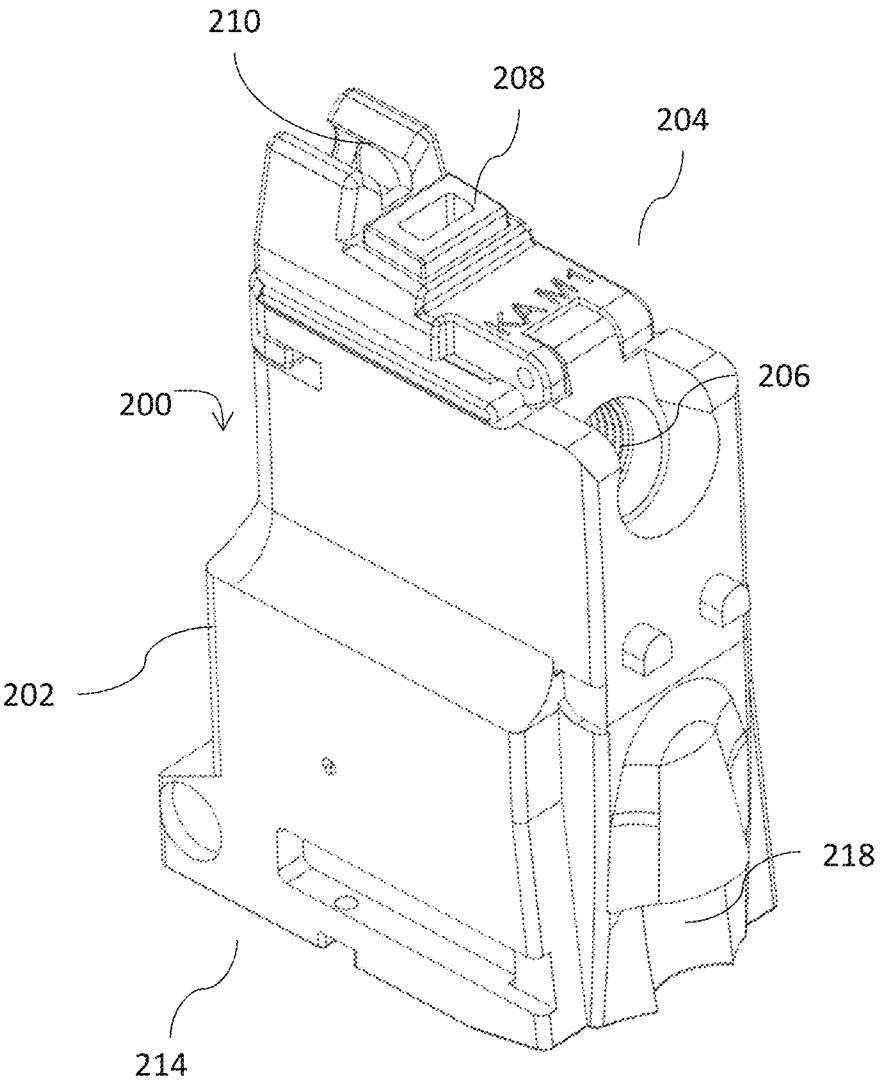
FIG. 2A depicts a top perspective view of an adapter for airsoft guns, according to a second embodiment.
Figure 2C:
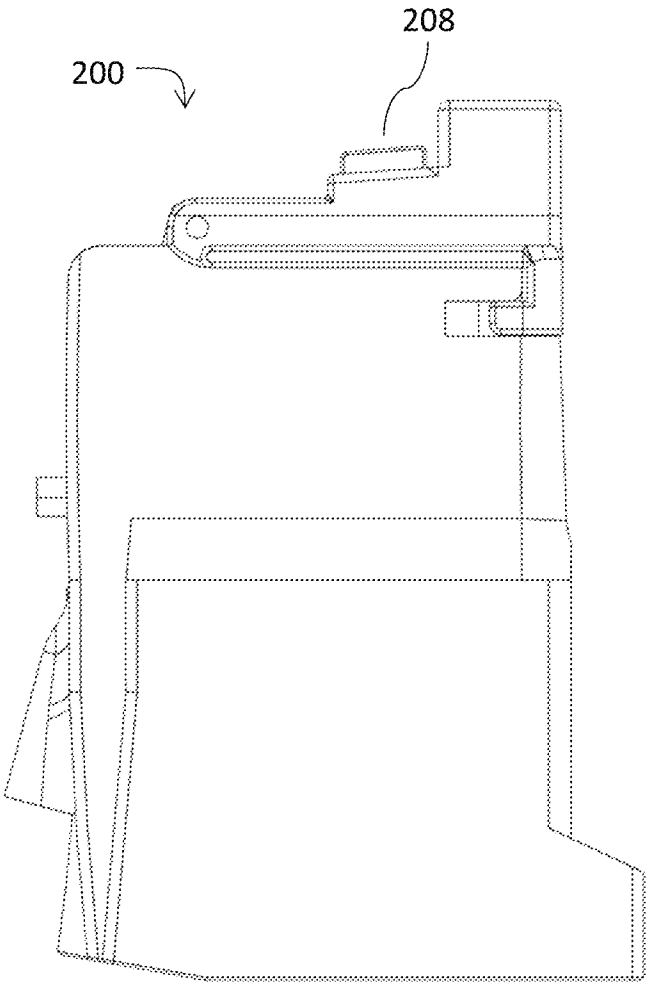
FIG. 2C depicts a right-side view of the adapter for airsoft guns, according to the second embodiment.
Figure 2B:
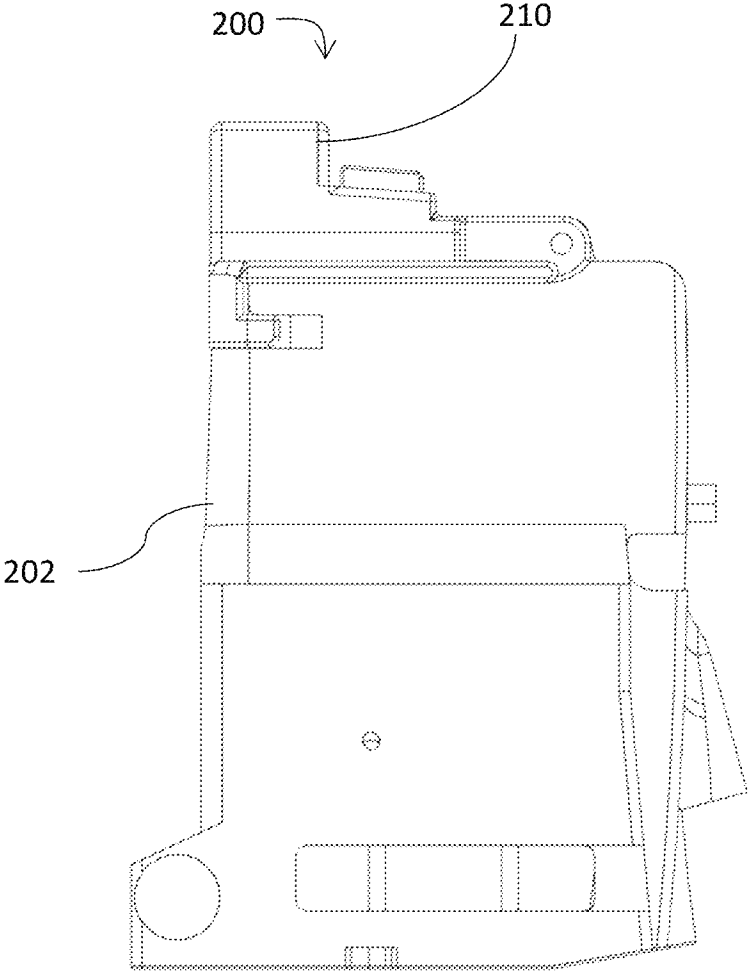
FIG. 2B depicts a left-side view of the adapter for airsoft guns, according to the second embodiment.
Figure 2G:
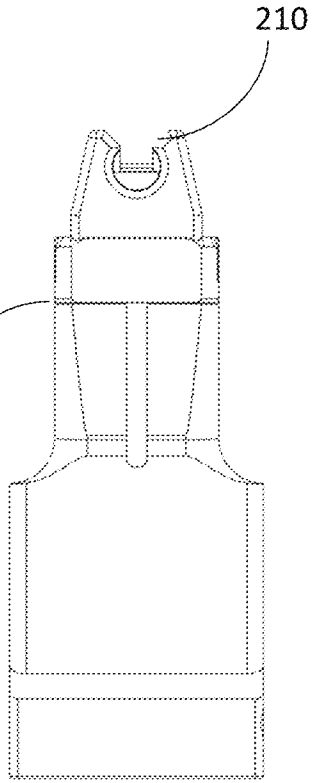
FIG. 2G depicts a front view of the adapter for airsoft guns, according to the second embodiment.
Figure 2F:
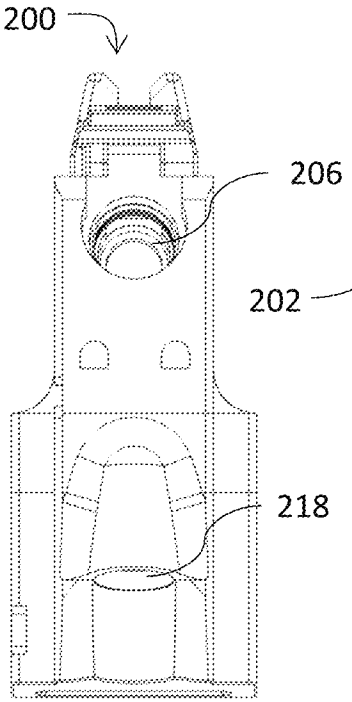
FIG. 2F depicts a rear view of the adapter for airsoft guns, according to the second embodiment.
Figure 2E:
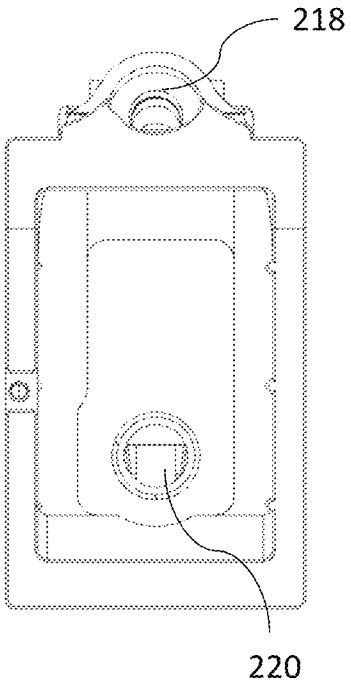
FIG. 2E depicts a bottom view of the adapter for airsoft guns, according to the second embodiment.
Figure 2D:
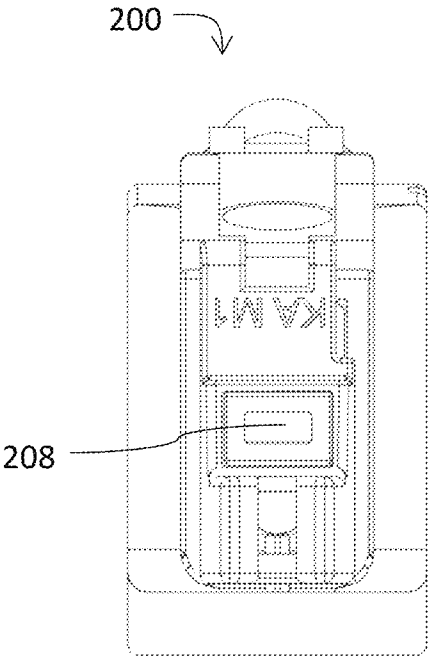
FIG. 2D depicts a top view of the adapter for airsoft guns, according to the second embodiment.
Figure 2H:
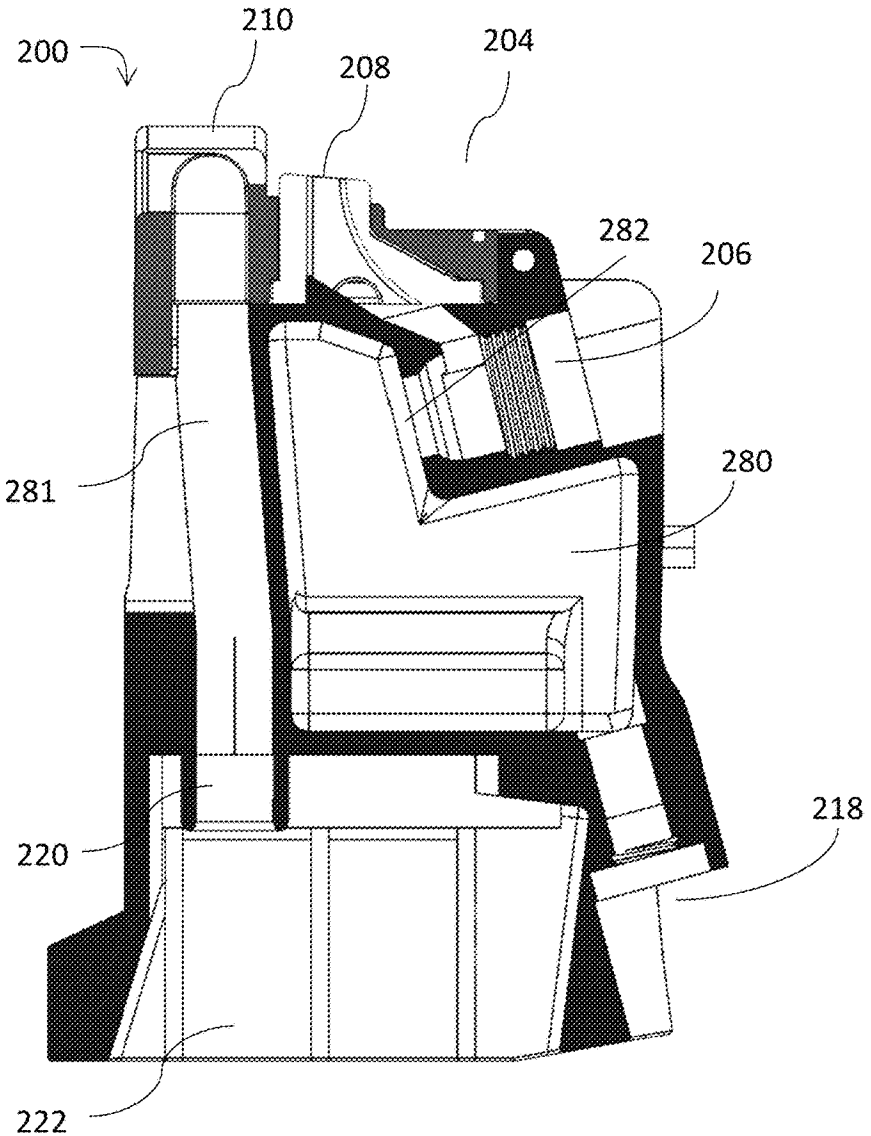
FIG. 2H depicts a cross-sectional side view of the adapter for airsoft guns, according to the second embodiment.
Figure 3A:
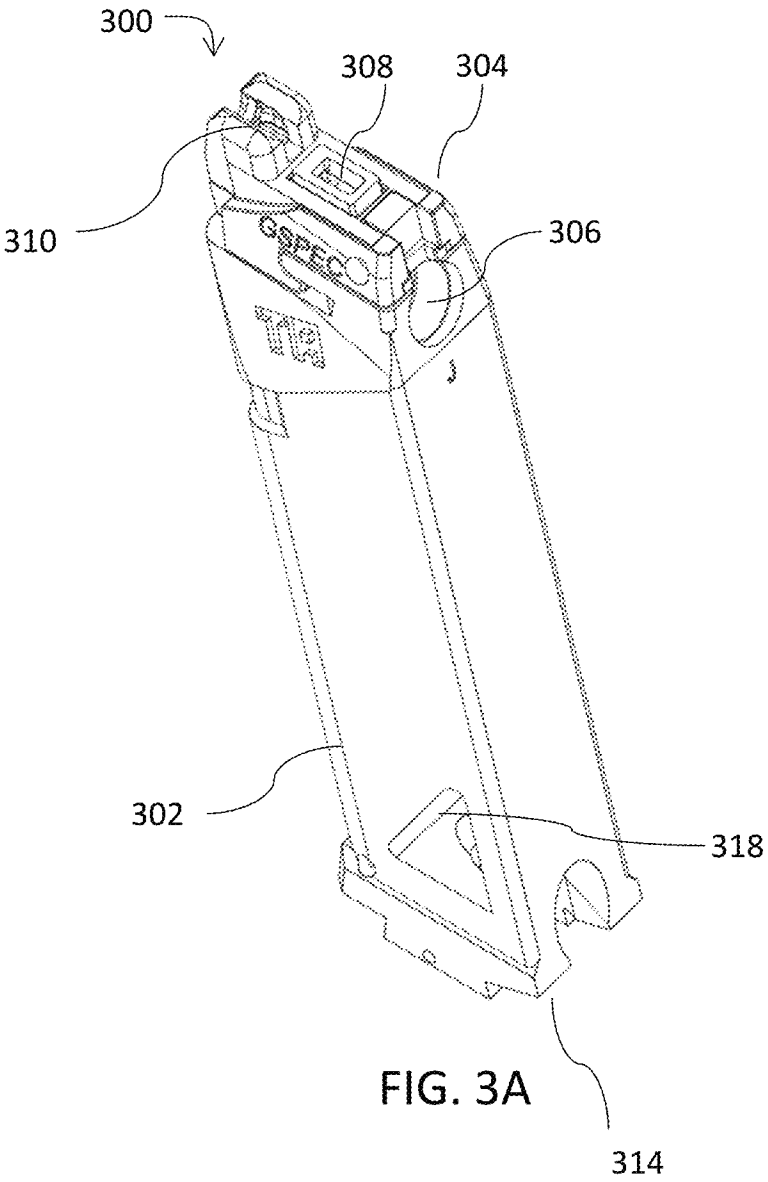
FIG. 3A depicts a top perspective view of an adapter for airsoft guns, according to a third embodiment.
Figure 3B:
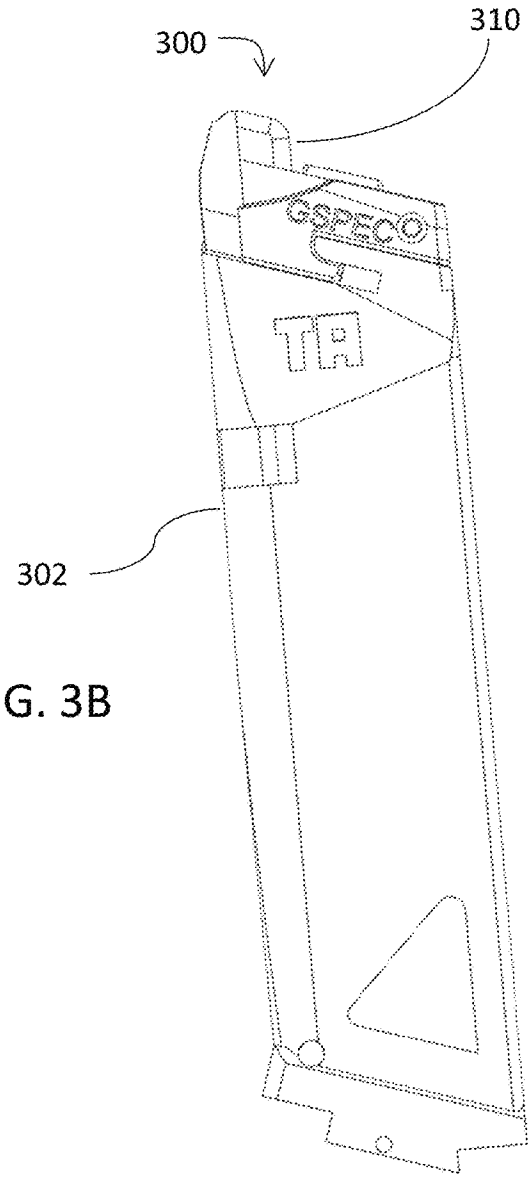
FIG. 3B depicts a right-side view of the adapter for airsoft guns, according to the third embodiment.
Figure 3C:
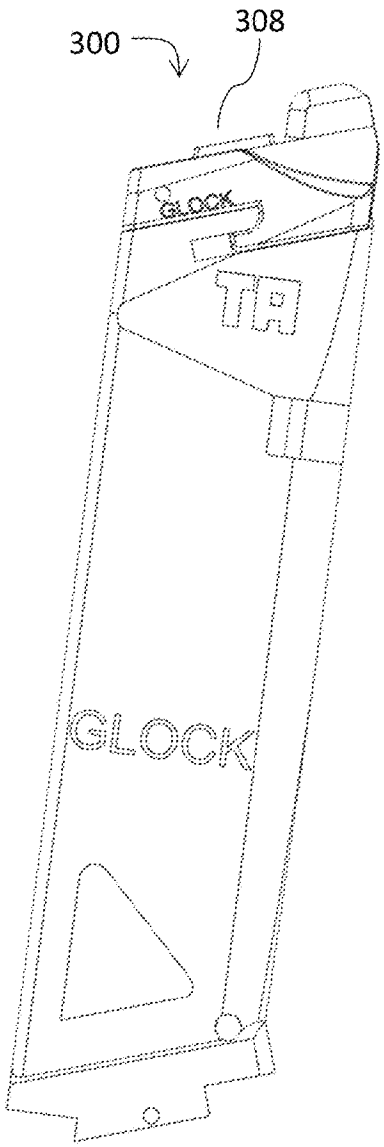
FIG. 3C depicts a left-side view of the adapter for airsoft guns, according to the third embodiment.
Figure 3H:
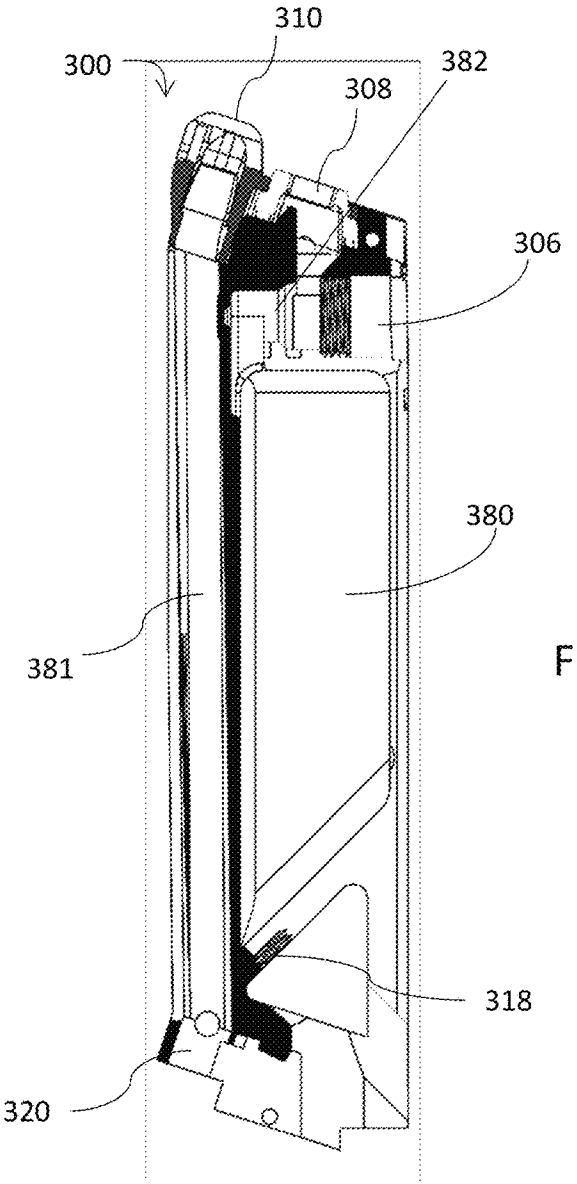
FIG. 3H depicts a cross-sectional side view of the adapter for airsoft guns, according to the third embodiment.
Figure 4A:
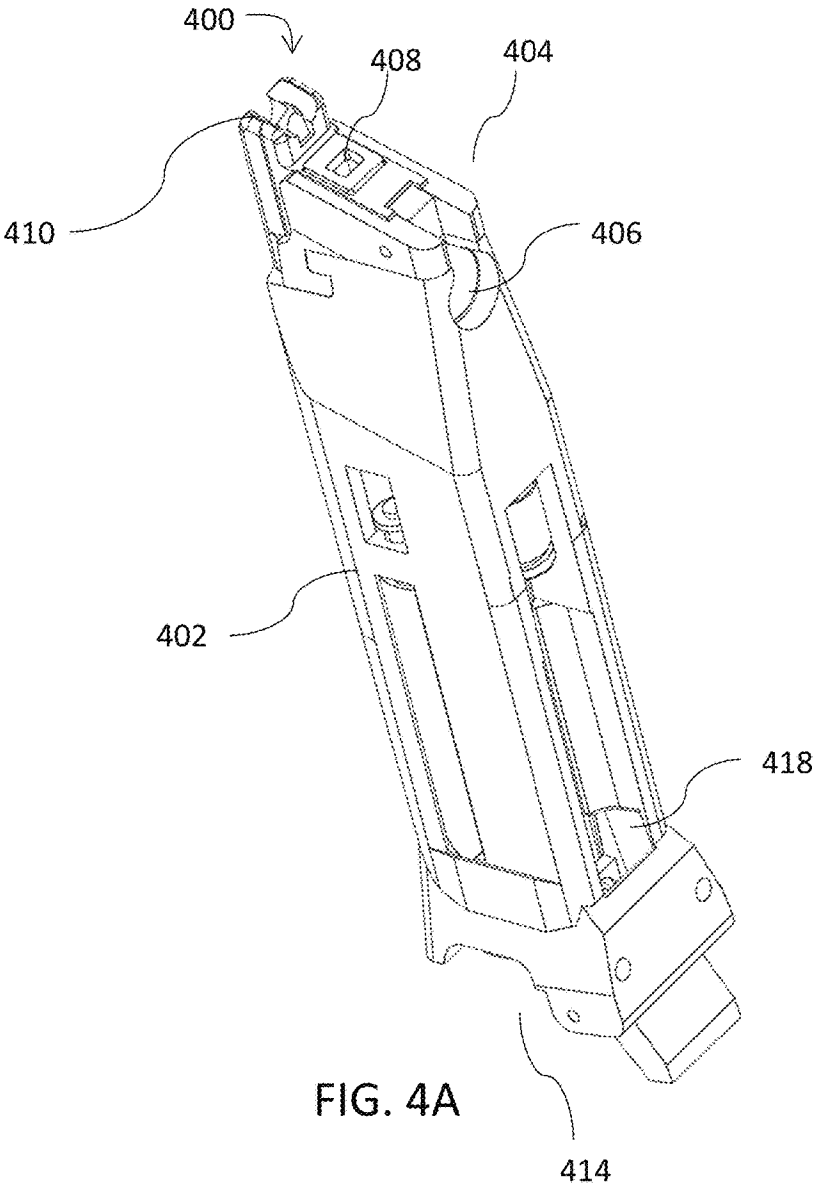

FIG. 4A depicts a top perspective view of an adapter for airsoft guns, according to a fourth embodiment.

Figure 4C:
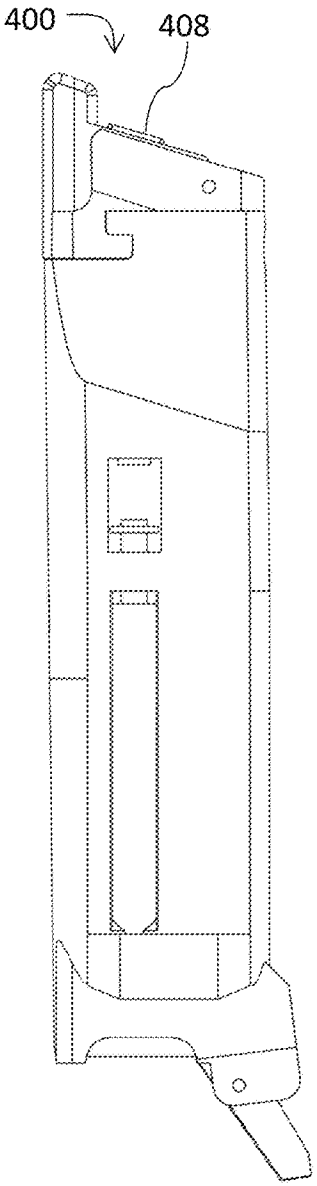
Figure 4B:
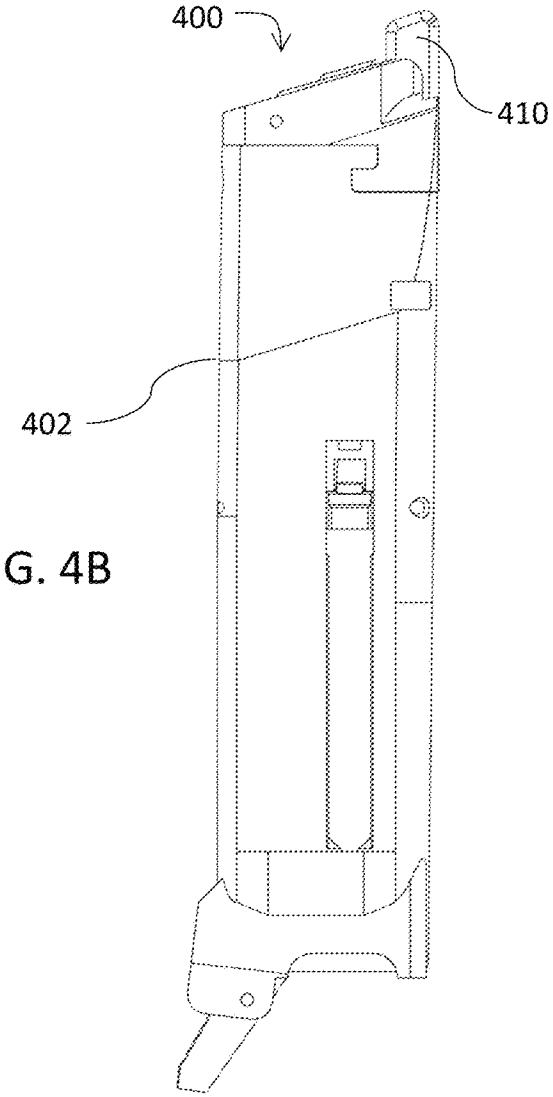

FIG. 4B depicts a left-side view of the adapter for airsoft guns, according to the fourth embodiment.

FIG. 4C depicts a right-side view of the adapter for airsoft guns, according to the fourth embodiment.

Figure 4G:
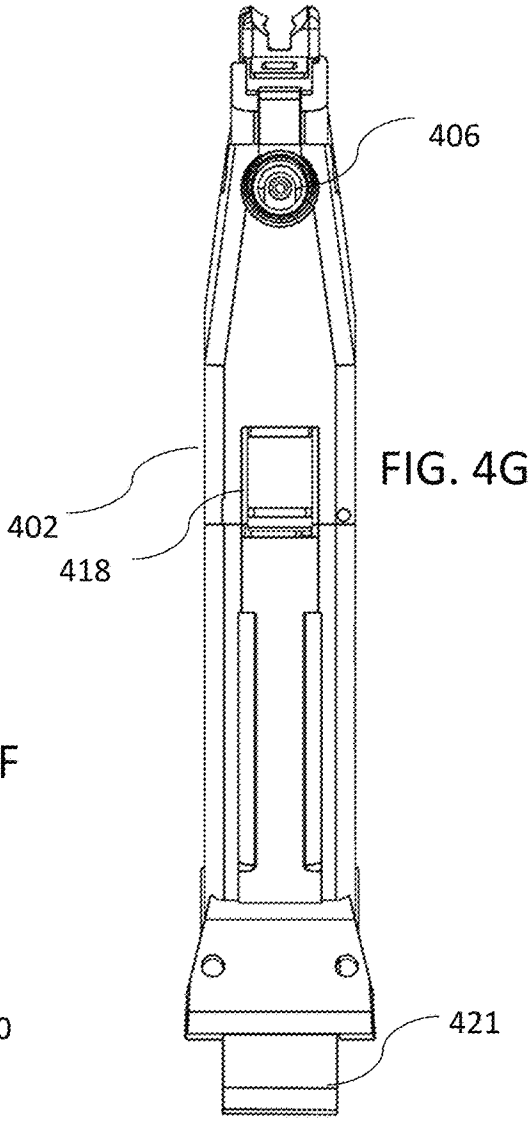
Figure 4F:
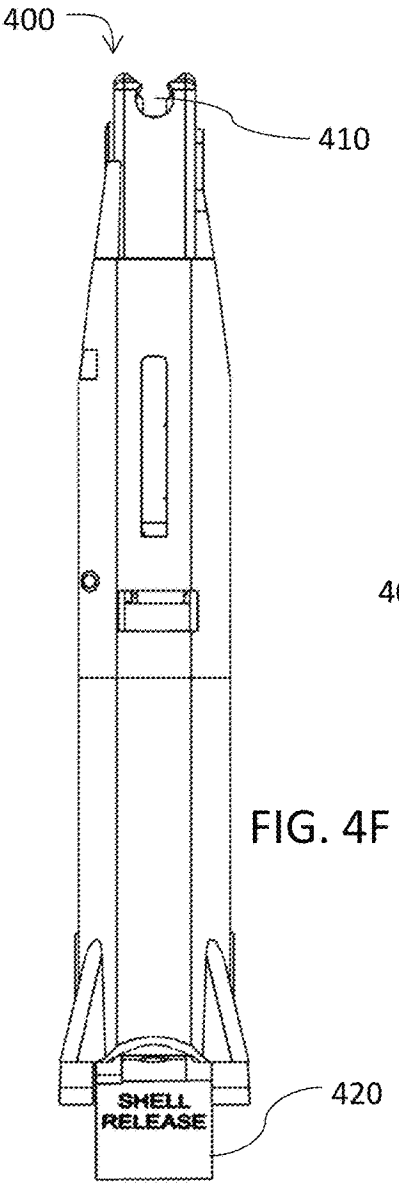
Figure 4D:
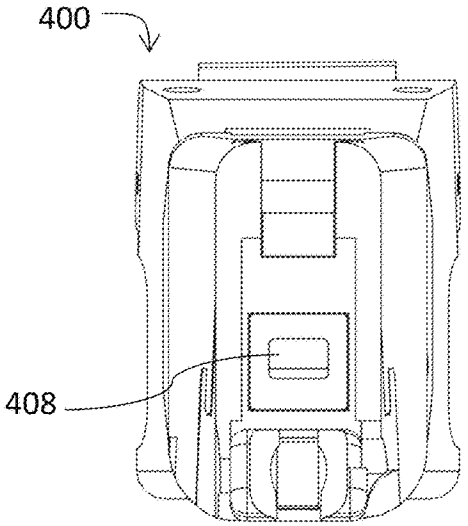

FIG. 4D depicts a top view of the adapter for airsoft guns, according to the fourth embodiment.

Figure 4E:
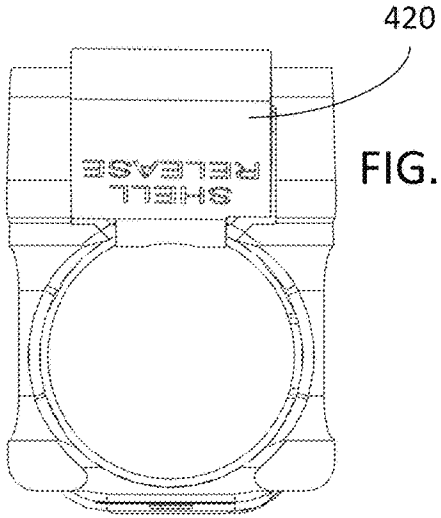

FIG. 4E depicts a bottom view of the adapter for airsoft guns, according to the fourth embodiment.

FIG. 4F depicts a rear view of the adapter for airsoft guns, according to the fourth embodiment.

FIG. 4G depicts a front view of the adapter for airsoft guns, according to the fourth embodiment.

Figure 4H:
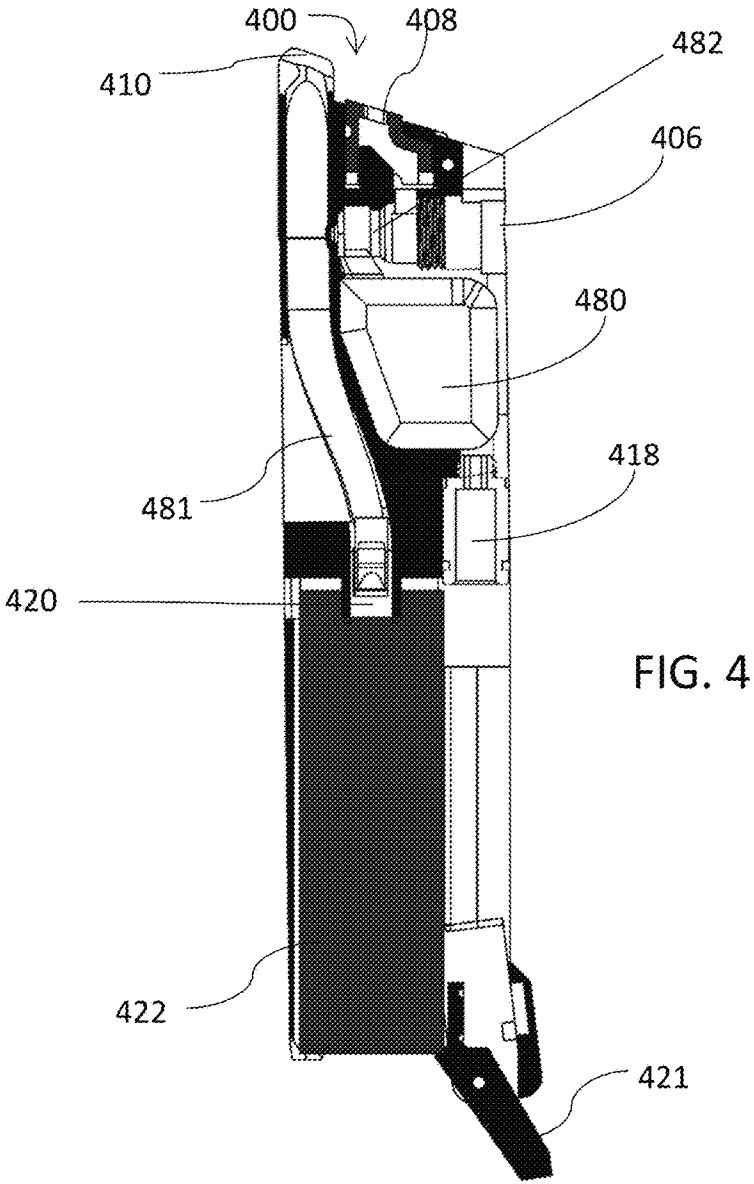

FIG. 4H depicts a cross-sectional side view of the adapter for airsoft guns, according to the fourth embodiment.

Figure 5A:
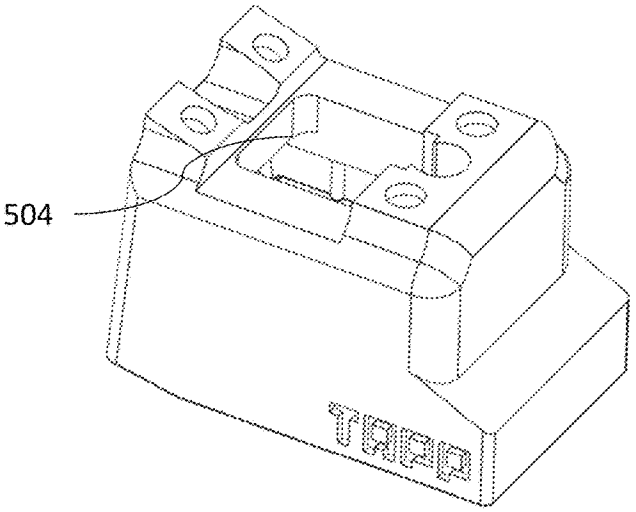

FIG. 5A is a depicts a top perspective view of a lower modular element for the claimed adapter for airsoft guns, according to one embodiment.

Figure 5B:
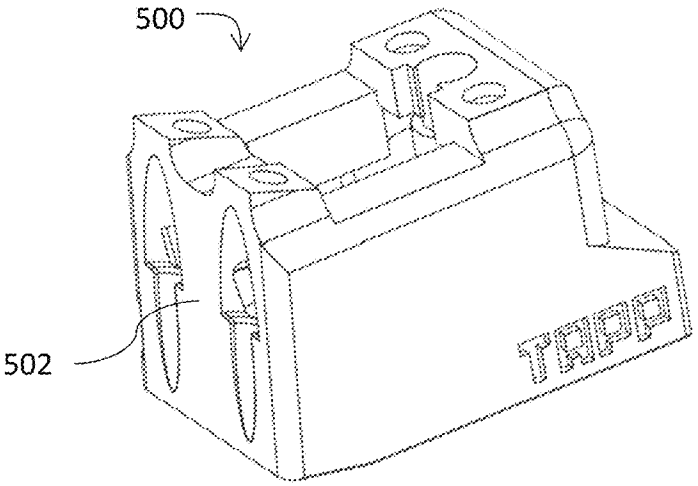

FIG. 5B is a depicts a side perspective view of the lower modular element for the claimed adapter for airsoft guns, according to one embodiment.

Figure 5C:
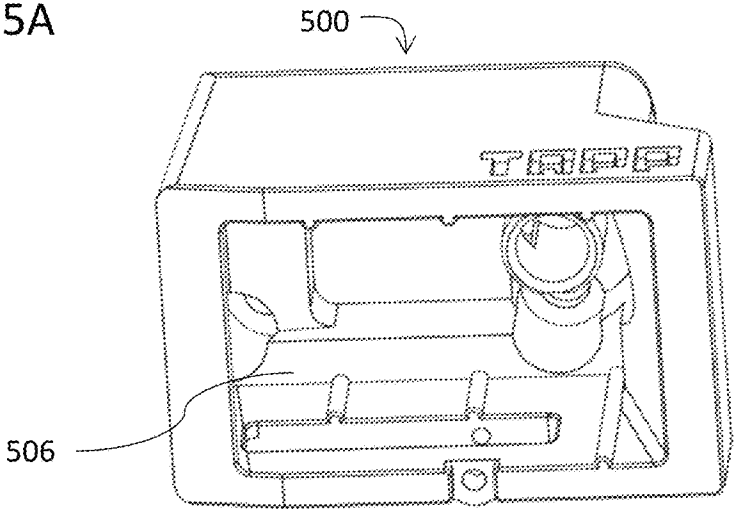

FIG. 5C is a depicts a bottom perspective view of the lower modular element for the claimed adapter for airsoft guns, according to one embodiment.

Figure 5E:
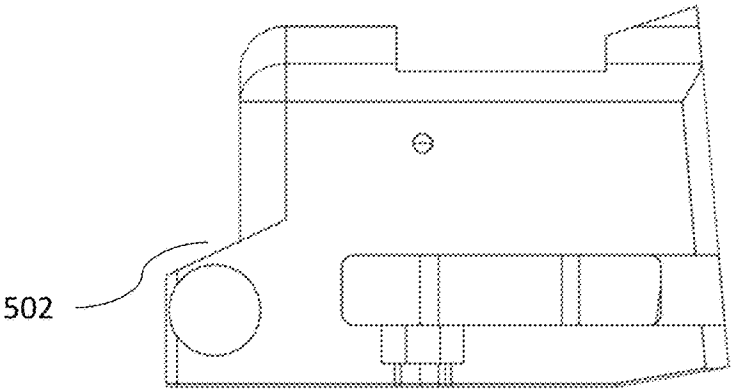
Figure 5G:
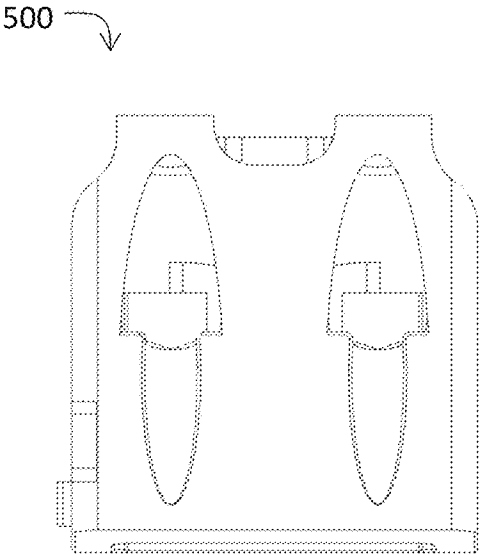
Figure 5D:
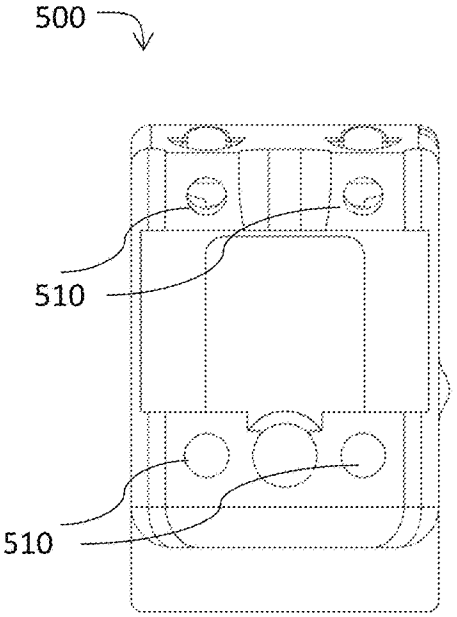

FIG. 5D is a depicts a top view of the lower modular element for the claimed adapter for airsoft guns, according to one embodiment.

FIG. 5E is a depicts a side view of the lower modular element for the claimed adapter for airsoft guns, according to one embodiment.

Figure 5F:
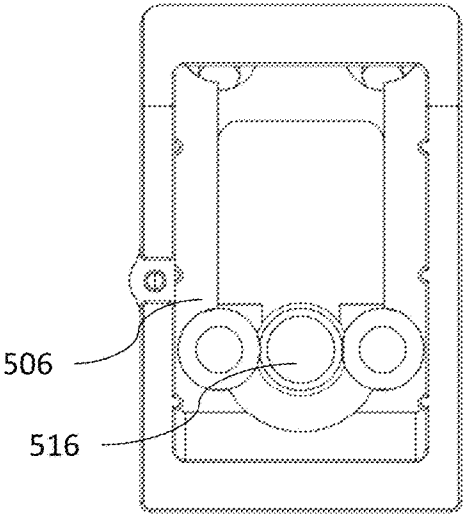

FIG. 5F is a depicts a bottom view of the lower modular element for the claimed adapter for airsoft guns, according to one embodiment.

FIG. 5G is a depicts a rear view of the lower modular element for the claimed adapter for airsoft guns, according to one embodiment.

Figure 5J:
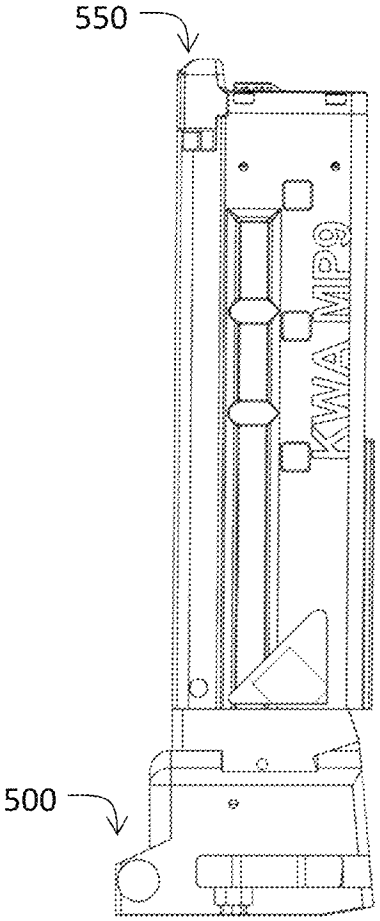
Figure 5I:
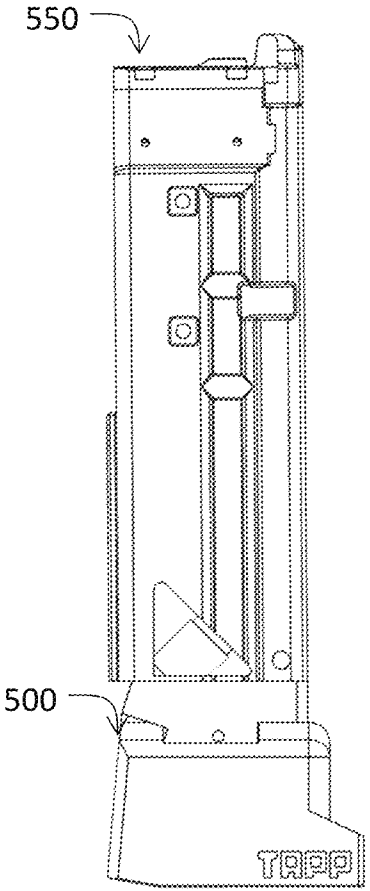
Figure 5H:
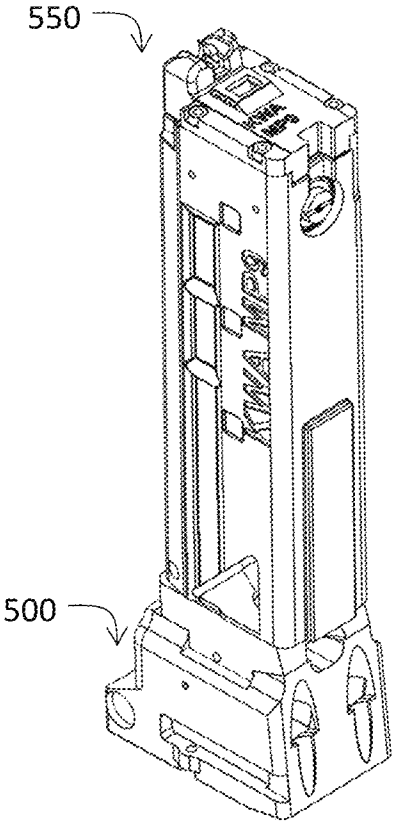

FIG. 5H is a depicts a side perspective view of the lower modular element connected to the claimed adapter for airsoft guns, according to one embodiment.

FIG. 5I is a depicts a left-side view of the lower modular element connected to the claimed adapter for airsoft guns, according to one embodiment.

FIG. 5J is a depicts a right-side view of the lower modular element connected to the claimed adapter for airsoft guns, according to one embodiment.

Figure 6B:
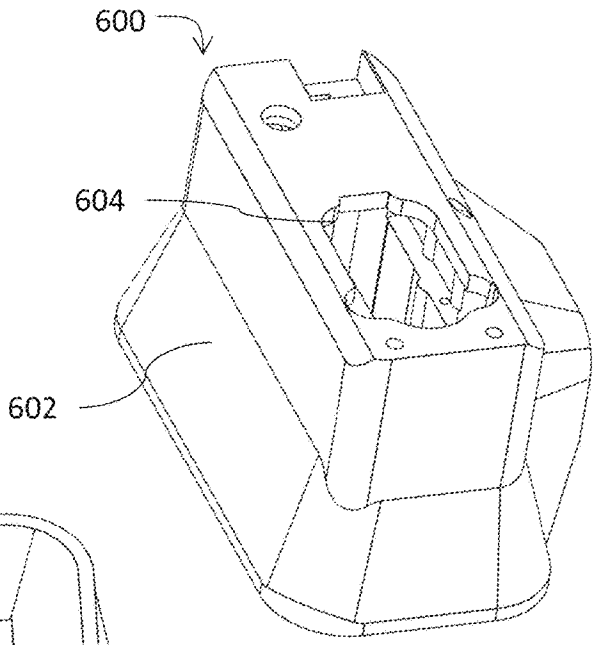
Figure 6C:
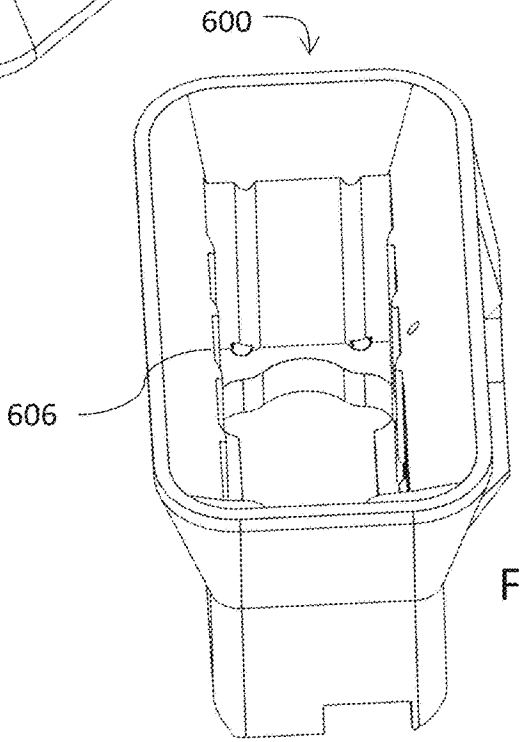
Figure 6A:
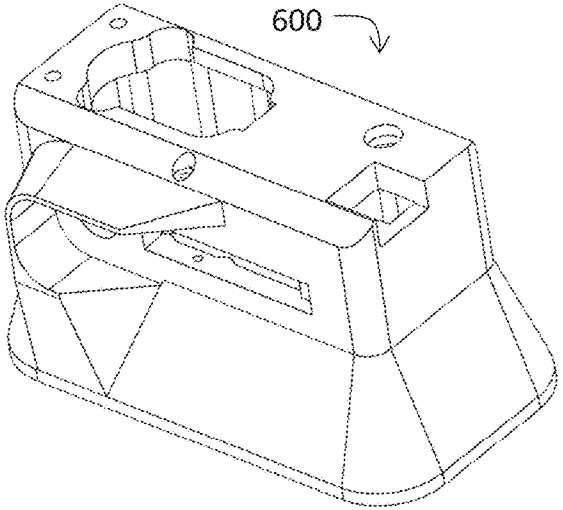

FIG. 6A is a depicts a top perspective view of a lower modular element for the claimed adapter for airsoft guns, according to another embodiment.

FIG. 6B is a depicts a rear perspective view of the lower modular element for the claimed adapter for airsoft guns, according to another embodiment.

FIG. 6C is a depicts a bottom perspective view of the lower modular element for the claimed adapter for airsoft guns, according to another embodiment.

Figure 6E:
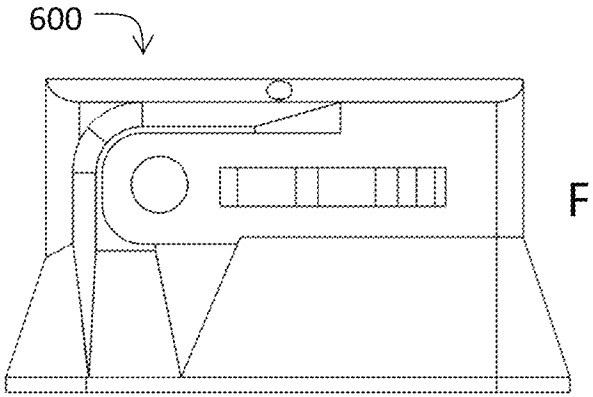
Figure 6G:
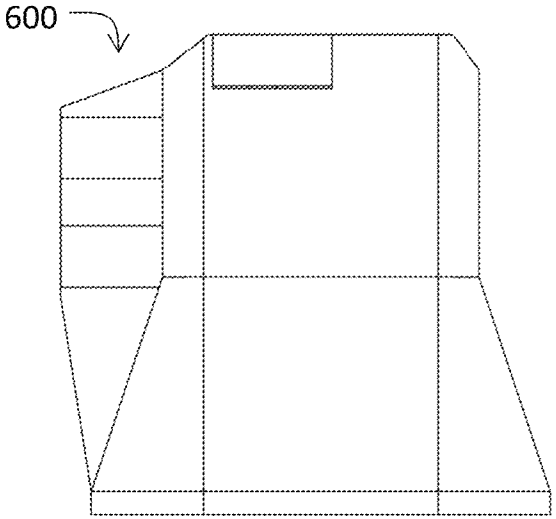
Figure 6D:
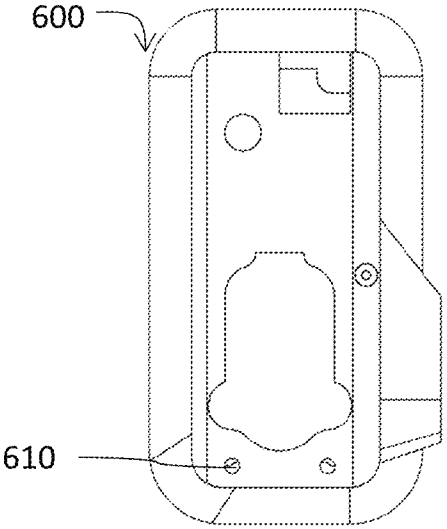

FIG. 6D is a depicts a top view of the lower modular element for the claimed adapter for airsoft guns, according to another embodiment.

FIG. 6E is a depicts a side view of the lower modular element for the claimed adapter for airsoft guns, according to another embodiment.

Figure 6F:
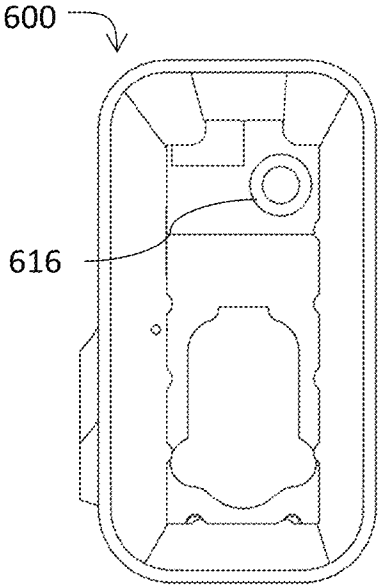

FIG. 6F is a depicts a bottom view of the lower modular element for the claimed adapter for airsoft guns, according to another embodiment.

FIG. 6G is a depicts a front view of the lower modular element for the claimed adapter for airsoft guns, according to another embodiment.

DETAILED DESCRIPTION

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing an adapter for airsoft guns that increases the compatibility of the airsoft gun. The claimed subject matter presents an inexpensively manufactured adapter that can be used with a variety of different gas canisters and magazines, which increases the usability of the airsoft gun. The claimed subject matter presents a significant breakthrough in the realm of airsoft sport by addressing the long-standing issue of component compatibility. The claimed subject matter enhances the flexibility and customization options for airsoft users by allowing a gas-powered airsoft gun to utilize a variety of different gas canisters and magazines, from various different manufacturer. By introducing such compatibility, one increases the range of choices available to airsoft users, and also reduces costs associated with sourcing specific, possibly rare or expensive, brand-dedicated components. The claimed subject matter democratizes the usage of gas canisters and magazines, liberating users from the constraints of proprietary design.

Moreover, the claimed subject matter reshapes the strategic dynamics of airsoft games. Using the claimed device, players can now more easily share resources during matches, lending their magazines or gas canisters to teammates as needed, thereby promoting cooperation and improving team tactics. With the problem of compatibility reduced or eliminated, more focus can be put on the actual gameplay and tactics, enhancing the overall experience for airsoft players. Additionally, the ability to experiment freely with different types of gas canisters and magazines without worrying about compatibility could foster increased innovation and customization within the sport. The claimed subject matter serves as a step forward in the evolution of airsoft, enhancing player experience, fostering camaraderie, and driving the sport's continual growth.

The accompanying drawings, which are incorporated in and constitute a part of this disclosure, illustrate various example embodiments. The claimed adapter for airsoft guns will now be described with respect to the Figures.

The airsoft gun adapter 100 features a housing 102 made from a single, integrally formed plastic element, which may be 3D printed using a 3D printer. The housing serves as the primary structural component of the airsoft gun adapter 100. The housing is designed to accommodate all the other internal components, offering a unified body for the entire mechanism. The upper portion 104 of the housing is specifically molded to fit into the magazine well of an airsoft gun, ensuring secure attachment and providing a clear path for the pressurized air and projectiles. The upper portion 104 of the housing is specifically shaped and sized to allow for a friction fit with the magazine well of an airsoft gun. The projectiles may be plastic BBs, metal BBs, gel balls, etc.

Within the housing is an air reservoir 180 specifically purposed for storing pressurized gas. The air reservoir is enclosed within this housing, storing the pressurized gas necessary to propel the projectiles. The air reservoir is configured to withstand gas pressures of between 100-130 psi or 120-150 psi. At the bottom 114 of the housing, there's an air inlet 118 that connects to the air reservoir and is designed to allow the entry of pressurized air from a gas canister that can be attached to the housing 102. The air inlet comprises a threaded bore for connecting to a pressurized air source.

Towards the upper portion 104 of the housing, an air outlet 108 is positioned. This outlet is linked to the air reservoir and is set up to let the pressurized air flow from the reservoir to the connected airsoft gun. The air outlet at the top of the housing connects to the air reservoir and is designed to allow the release of this pressurized air towards the airsoft gun when required. The reservoir directly communicates with the air inlet and the air outlet, controlling the movement of pressurized air within the adapter. The air inlet, located at the bottom of the housing, serves as the entry point for the pressurized gas from an attached gas canister, effectively replenishing the reservoir. The air outlet comprises substantially a rectangular shape.

There's also a plunger 106 situated within the housing, the plunger configured to contact a piston valve 107 that is located between the air reservoir 180 and the air outlet 108. A piston valve is a device used to control the motion of a gas or fluid along a conduit by means of the linear motion of a piston within a chamber or cylinder. The piston valve 107 is designed to stop the air flow from the reservoir to the outlet when it's in a rest position. It is kept in the rest position using a spring that keeps the piston valve 107 in place in a bottleneck formation 182 situated between the air reservoir 180 and the air outlet 108 so that no air can pass through between the two. However, when the airsoft gun's firing pin contacts the plunger, the plunger contacts the piston valve, which puts the piston valve in the activated position. In the activated position, the piston valve has a distal portion that moves away from the bottleneck and allows temporary airflow through the bottleneck from the air reservoir to the air outlet. This high-pressure air flow powers the movements of the projectiles through and out of the airsoft gun. After being contacted by the plunger, the piston valve moves back to its rest position under the force of its spring.

Note that the piston valve 107 acts as a gatekeeper between the air reservoir and the air outlet. When at rest, it blocks the airflow from the reservoir to the outlet, ensuring that the pressurized gas only moves when the gun is fired. The piston valve 107 is triggered by contact with the plunger which is triggered by contact with the airsoft gun's firing pin, momentarily placing the piston valve in the activated position, and allowing the passage of pressurized air from the reservoir through the outlet. Note that the plunger 106, configured to contact the piston valve 107, is kept in a rest position using a spring that keeps the plunger in place. However, when the airsoft gun's firing pin contacts the plunger, the plunger is placed in the activated position and moves to contact the piston valve. After said contact, the plunger moves back to its rest position under the force of its spring.

The adapter 100 also includes a projectile inlet 120 at the bottom 114 of the housing. This inlet is designed to let projectiles enter from an attached projectile magazine. The projectile inlet is configured for a friction fit with the projectile magazine. At the top 104 of the housing, a projectile outlet 110 is situated. This projectile outlet is linked with the projectile inlet via a projectile conduit 181 wherein the projectile moves from the projectile inlet to the projectile outlet using spring propulsion. The projectile outlet 110 is structured to allow the projectiles to exit towards the airsoft gun. Note the projectile inlet is strategically located at the bottom of the housing and is designed to allow the entry of projectiles from an attached projectile magazine, synchronizing the flow of projectiles with the burst of pressurized air. The projectile outlet, on the other hand, is positioned at the top of the housing, in direct connection with the projectile inlet. This allows the exit of projectiles towards the airsoft gun, following the path of the pressurized air. The projectile outlet comprises a tubular feeder 190 configured for mating with a projectile acceptor in the airsoft gun.

FIGS. 2A-2H depict a second embodiment of an airsoft gun adapter 200 that also includes a housing 202, a top 204, bottom 214, piston valve 206, air inlet 218, air outlet 208, projectile inlet 220, projectile outlet 210, projectile conduit 281, air reservoir 280 and bottleneck 282. Note the second embodiment 200 is smaller than the first embodiment 100 and is meant for insertion into a smaller magazine well. Note also that the second embodiment 200 does not include a plunger. In this embodiment, the airsoft gun's firing pin contacts the piston valve 206 directly. FIGS. 2A-2H also show a magazine well 222 within a cavity of the body or housing 202 of the adapter 200.

FIGS. 3A-3H depict a third embodiment of an airsoft gun adapter 300 that also includes a housing 302, a top 304, bottom 314, piston valve 306, air inlet 318, air outlet 308, projectile inlet 320, projectile outlet 310, projectile conduit 381, air reservoir 380 and bottleneck 382. Note the third embodiment 300 is longer than the first embodiment 100 and is meant for insertion into a magazine well for a pistol type weapon. Note also that the third embodiment 300 does not include a plunger. In this embodiment, the airsoft gun's firing pin contacts the piston valve 306 directly.

FIGS. 4A-4H depict a fourth embodiment of an airsoft gun adapter 400 that also includes a housing 402, a top 404, bottom 414, piston valve 406, air inlet 418, air outlet 408, projectile inlet 420, projectile outlet 410, projectile conduit 481, air reservoir 480 and bottleneck 482. Note the fourth embodiment 400 is longer than the first embodiment 100 and is meant for insertion into a magazine well for a pistol type weapon. Note also that the fourth embodiment 400 does not include a plunger. In this embodiment, the airsoft gun's firing pin contacts the piston valve 406 directly. FIGS. 4A-4H also show a magazine release lever 421 at the bottom of the adapter 400 and a magazine well 422 within a cavity of the body or housing 402 of the adapter 400.

FIGS. 5A-5G depict different views of a lower modular element 500 for the claimed adapter (100, 200, 300, 400) for airsoft guns, according to one embodiment. The lower module element is an intermediate element that is configured to be placed between the adapter and the airsoft gun, with its purpose being that it accommodates a particular magazine. There are many, perhaps hundreds, of different magazine designs and an adapter cannot be manufactured that fits all such magazines. The purpose of the adapter is that it configured to attach to the claimed adapter (100, 200, 300, 400) on the top end and to a particular magazine at the bottom end. Lower modular element 500 comprises a body 502 having a cavity 504 at its top end configured for accommodating the pass through of projectiles from the magazine and/or pressurized gas from a canister and towards the adapter and eventually to the airsoft gun. Lower modular element 500 also includes a cavity 506 at its bottom end configured for accommodating a magazine. The bottom of lower modular element 500 includes an orifice 516 for the pass through of projectiles from the magazine towards the airsoft gun, via the adapter. The top of lower modular element 500 includes multiple orifices 510 for accepting fasteners, such as screws or bolts, for attaching the lower modular element to the adapter.

FIGS. 5H-5J depict different views of the lower modular element 500 attached to an adapter 550 similar to the claimed adapter (100, 200, 300, 400) for airsoft guns, according to one embodiment. The figures show that the top of the lower modular element 500 is fastened, coupled or attached to the bottom of the adapter 550. A magazine is then fastened, coupled or attached to the bottom of the lower modular element 500.

FIGS. 6A-6G depict different views of a lower modular element 600 (similar to lower modular element 500) for the claimed adapter (100, 200, 300, 400) for airsoft guns, according to another embodiment. Lower modular element 600 comprises a body 602 having a cavity 604 at its top end configured for accommodating the pass through of projectiles from the magazine and/or pressurized gas from a canister and towards the adapter and eventually to the airsoft gun. Lower modular element 600 also includes a cavity 606 at its bottom end configured for accommodating a magazine. The bottom of lower modular element 600 includes an orifice 616 for the pass through of projectiles from the magazine towards the airsoft gun, via the adapter. The top of lower modular element 600 includes multiple orifices 610 for accepting a fastener, such as a screw or bolt, for attaching the lower modular element to the adapter.

Each element of the adapters 100, 200, 300, 400 and lower modular elements 500, 600 may be composed of injection-molded plastic, specifically types like ABS or polycarbonate. These plastics are known for their strength, rigidity, and resistance to impact, which are essential for an airsoft adapter expected to withstand the force of pressurized air and projectiles. Moreover, plastic is lightweight, making it easier for the airsoft player to maneuver the gun. Plastic's low-cost nature also makes mass production more economically viable, which is advantageous for both the manufacturer and end consumer.

The advent of 3D printing technology opens up a host of additional possibilities for manufacturing materials. Each element of the adapters 100, 200, 300, 400 and lower modular elements 500, 600 may be composed of materials like thermoplastic polyurethane (TPU) or polylactic acid (PLA) could be used to 3D print the adapter, allowing for rapid prototyping and even small-batch or custom production runs. This is particularly beneficial for testing different design modifications or creating adapters tailored for specific airsoft guns or user needs. 3D-printed materials can also be blended with additives such as carbon fiber or metal particles to improve their mechanical properties, potentially offering a balance between lightweight design and robust strength. Both traditional plastics and 3D-printing materials may be used for the creation of a high-performance, cost-effective airsoft adapter.

Each element of the adapters 100, 200, 300, 400 and lower modular elements 500, 600 may be composed of metals such as aluminum, which is a lightweight yet strong metal that is highly resistant to corrosion. Aluminum's lightness would ensure that the adapter doesn't add unnecessary weight to the airsoft gun, allowing for easier maneuverability during gameplay. Moreover, aluminum is relatively easy to machine and can also be anodized to add an extra layer of surface protection and even color customization, which could be appealing to users.

Each element of the adapters 100, 200, 300, 400 and lower modular elements 500, 600 may be composed of stainless steel, offering exceptional strength and durability. Unlike aluminum, stainless steel can withstand higher pressures and forces, making it an ideal choice for the air reservoir and other stress-bearing parts of the adapter. Another potential candidate is titanium, which offers a balance between the lightweight nature of aluminum and the extreme durability of stainless steel, though at a significantly higher cost. Titanium would be an excellent choice for those looking to achieve premium performance from their airsoft gun adapter without any compromise on material strength or weight. When it comes to manufacturing techniques for metal components, options such as CNC machining, die-casting, and metal injection molding could all be considered.

Each element of the adapters 100, 200, 300, 400 and lower modular elements 500, 600 has been carefully engineered to work in harmony with one another, providing a solution that enhances compatibility across different airsoft guns, gas canisters, and magazines. By integrating all these elements into a unified design, the adapters 100, 200, 300, 400 and lower modular elements 500, 600 allow pressurized gas and projectiles to be effectively channeled from a variety of sources to the airsoft gun, increasing its usability, flexibility, and performance in the field.

The main advantage of the adapters 100, 200, 300, 400 and lower modular elements 500, 600 over the prior art lies in their ability to seamlessly bridge the gap between different components, particularly gas canisters and magazines, across various airsoft gun models. Prior to the claimed invention, airsoft enthusiasts often faced challenges sourcing specific, potentially rare or expensive, brand-dedicated components due to the proprietary designs of different airsoft guns. Each gun model typically accepted only a specific type of gas canister and magazine designed for that model. This lack of universal compatibility created not just a logistical issue, but also placed constraints on the performance and versatility of the airsoft guns, as users couldn't freely interchange or experiment with different components to potentially improve their game.

The claimed invention changes this by introducing a standardization previously absent in the field of airsoft guns. By offering compatibility with various gas canisters and magazines, the claimed invention increases the flexibility of airsoft guns and allows users to choose from a wider range of components, depending on their specific needs or preferences. This can not only potentially enhance the performance of the guns but also reduce costs associated with sourcing specific components. Additionally, the adapter's unique integrated design-housing, air reservoir, air inlet, air outlet, piston valve, projectile inlet, and projectile outlet-allows for a more efficient and streamlined operation, leading to a potentially improved user experience over prior models. This puts the adapters 100, 200, 300, 400 and lower modular elements 500, 600 ahead of the prior art in terms of functionality, versatility, and user convenience.

Embodiments may be described above with reference to functions or acts, which comprise methods. The functions/acts noted above may occur out of the order as shown or described. For example, two functions/acts shown or described in succession may in fact be executed substantially concurrently or the functions/acts may sometimes be executed in the reverse order, depending upon the functionality/acts involved. While certain embodiments have been described, other embodiments may exist. Further, the disclosed methods' functions/acts may be modified in any manner, including by reordering functions/acts and/or inserting or deleting functions/acts, without departing from the spirit of the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An adapter for an airsoft gun, comprising:

a) a housing comprising a single, integrally formed plastic element, the housing having an upper portion configured to mate with a magazine well of the airsoft gun;

b) an air reservoir located within the housing, the air reservoir for holding pressurized gas;

c) an air inlet located at a bottom of the housing, the air inlet coupled with the air reservoir and configured for allowing ingress of pressurized air from an attached gas canister;

d) an air outlet located at a top of the housing, the air outlet coupled with the air reservoir and configured for allowing egress of pressurized air from the air reservoir to the airsoft gun;

e) a piston valve located within the housing between the air reservoir and the air outlet, the piston valve configured for preventing airflow from the air reservoir to the air outlet when in the rest position, and allowing temporary airflow from the air reservoir to the air outlet when contacted by a firing pin of the airsoft gun;

f) a projectile inlet located at the bottom of the housing, the projectile inlet configured for allowing ingress of projectiles from an attached projectile magazine; and g) a projectile outlet located at the top of the housing, the projectile outlet coupled with the projectile inlet and configured for allowing egress of projectiles to the airsoft gun.

2. The adapter for an airsoft gun of claim 1, wherein the housing is composed of a single, 3D printed plastic element.

3. The adapter for an airsoft gun of claim 2, wherein a top of the housing is configured for a friction fit with the magazine well of the airsoft gun.

4. The adapter for an airsoft gun of claim 3, wherein the air reservoir is configured to withstand gas pressures of between 120-150 psi.

5. The adapter for an airsoft gun of claim 4, wherein the air inlet comprises a threaded bore for connecting to a pressurized air source.

6. The adapter for an airsoft gun of claim 5, wherein the air outlet comprises substantially a rectangular shape.

7. The adapter for an airsoft gun of claim 6, wherein the piston valve comprises a spring configured to keep the piston valve in the rest position.

8. The adapter for an airsoft gun of claim 7, further comprising a bottleneck passage between the air reservoir and the air outlet, wherein the piston valve rests within the bottleneck when in the rest position.

9. The adapter for an airsoft gun of claim 8, wherein the projectile inlet is configured for a friction fit with the projectile magazine.

10. The adapter for an airsoft gun of claim 9, wherein the projectile outlet comprises a tubular feeder configured for mating with a projectile acceptor in the airsoft gun.

11. An adapter for an airsoft gun, comprising:

a) a housing comprising a single, integrally formed plastic element, the housing having an upper portion configured to mate with a magazine well of the airsoft gun;

b) an air reservoir located within the housing, the air reservoir for holding pressurized gas;

c) an air inlet located at a bottom of the housing, the air inlet coupled with the air reservoir and configured for allowing ingress of pressurized air from an attached gas canister;

d) an air outlet located at a top of the housing, the air outlet coupled with the air reservoir and configured for allowing egress of pressurized air from the air reservoir to the airsoft gun;

e) a piston valve located within the housing between the air reservoir and the air outlet, the piston valve configured for preventing airflow from the air reservoir to the air outlet when in the rest position, and allowing temporary airflow from the air reservoir to the air outlet when contacted by a firing pin of the airsoft gun;

f) a projectile inlet located at the bottom of the housing, the projectile inlet configured for allowing ingress of projectiles from an attached projectile magazine; and g) a projectile outlet located at the top of the housing, the projectile outlet coupled with the projectile inlet and configured for allowing egress of projectiles to the airsoft gun, wherein the projectile outlet comprises a tubular feeder configured for mating with a projectile acceptor in the airsoft gun.

12. The adapter for an airsoft gun of claim 11, wherein the housing is composed of a single, 3D printed plastic element.

13. The adapter for an airsoft gun of claim 12, wherein a top of the housing is configured for a friction fit with the magazine well of the airsoft gun.

14. The adapter for an airsoft gun of claim 13, wherein the air reservoir is configured to withstand gas pressures of between 120-150 psi.

15. The adapter for an airsoft gun of claim 14, wherein the air inlet comprises a threaded bore for connecting to a pressurized air source.

16. The adapter for an airsoft gun of claim 15, wherein the air outlet comprises substantially a rectangular shape.

17. The adapter for an airsoft gun of claim 16, wherein the piston valve comprises a spring configured to keep the piston valve in the rest position.

18. The adapter for an airsoft gun of claim 17, further comprising a bottleneck passage between the air reservoir and the air outlet, wherein the piston valve rests within the bottleneck when in the rest position.

19. The adapter for an airsoft gun of claim 18, wherein the projectile inlet is configured for a friction fit with the projectile magazine.

20. The adapter for an airsoft gun of claim 19, further comprising a lower modular element having a top portion and a bottom portion, the lower module element configured for coupling its top portion to a bottom of the airsoft gun and further for coupling its bottom portion to a magazine.

* * * * *